US006102007A

United States Patent [19]

Fürst

[11] Patent Number: 6,102,007

[45] Date of Patent: Aug. 15, 2000

[54] FUEL INJECTION SYSTEM

[75] Inventor: Thomas Fürst, Schwieberdingen, Germany

[73] Assignee: Robert Bosch GmbH, Stuttgart, Germany

[21] Appl. No.: 09/242,223

[22] PCT Filed: Mar. 19, 1998

[86] PCT No.: PCT/DE98/00810

§ 371 Date: Feb. 10, 1999

§ 102(e) Date: Feb. 10, 1999

[87] PCT Pub. No.: WO98/58169

PCT Pub. Date: Dec. 23, 1998

[30] Foreign Application Priority Data

Jun. 13, 1997 [DE] Germany ..... 197 25 076

[51] Int. Cl.[7] ..... F02M 55/02

[52] U.S. Cl. ..... 123/469; 123/470

[58] Field of Search ..... 123/456, 468, 123/469, 470

[56] References Cited

U.S. PATENT DOCUMENTS

| | | | |
|---|---|---|---|
| 4,201,172 | 5/1980 | Jaggle et al. | 123/470 |
| 4,445,713 | 5/1984 | Bruning | 123/469 |
| 4,519,371 | 5/1985 | Nagase et al. | 123/470 |
| 4,556,034 | 12/1985 | Anklam et al. | 123/470 |
| 4,693,223 | 9/1987 | Eshlemann et al. | 123/468 |
| 5,394,850 | 3/1995 | Murphy et al. | 123/470 |
| 5,752,487 | 5/1998 | Harrell et al. | 123/470 |
| 5,765,534 | 6/1998 | Brown et al. | 123/470 |

FOREIGN PATENT DOCUMENTS

| | | |
|---|---|---|
| 24 16 803 | 10/1975 | Germany . |
| 29 08 095 | 9/1980 | Germany . |
| 08 312503 | 3/1997 | Japan . |

*Primary Examiner*—Thomas N. Moulis
*Attorney, Agent, or Firm*—Kenyon & Kenyon

[57] ABSTRACT

A fuel injection system for injecting fuel into an internal combustion engine having at least one fuel injection valve, which has a fuel inlet orifice on an inlet section and having a fuel distribution line, which has, for each fuel injection valve a fuel outlet orifice that may be connected to the fuel inlet orifice of the fuel injection valve, and a connection fitting, connected downstream to the fuel outlet orifice. A connection arrangement injection valve to the respective fuel outlet orifice of the fuel distribution line is provided. The connection arrangement includes an annular seal support and a sleeve that can be inserted in the fuel inlet orifice. The annular seal support has a first sealing element for sealing the seal support against the inlet section of the fuel injection valve, and a second sealing element for sealing the seal support against the connection fitting of the fuel distribution line.

12 Claims, 2 Drawing Sheets

FUEL INJECTION SYSTEM

FIELD OF THE INVENTION

The present invention relates to a fuel injection system for injecting fuel into an internal combustion engine, in particular for direct injection of fuel into the combustion chamber (s) of the internal combustion engine.

BACKGROUND INFORMATION

Japanese Patent No. 08 312503 describes that location holes may be provided on the cylinder head of an internal combustion engine for one fuel injection valve for each combustion chamber in each hole, where an outlet section of the respective fuel injection valve for direct injection of fuel in the respective combustion chamber can be inserted. The fuel injection valve inserted in the location hole of the cylinder head is held down using a holding device designed as a bracket against the relatively high combustion pressure prevailing in the combustion chamber. In order to reliably secure the fuel injection valves in the location holes, relatively high hold-down forces must be exerted by the brackets on the fuel injection valves, so that the fuel injection valves have a relatively firm, unmovable seat in the location holes. Japanese Patent No. 08 312503 also describes a fuel distribution line with a fuel inlet orifice for supplying fuel to one of the inlet sections provided on each fuel injection valve; the fuel distribution line connects the fuel injection valves to a fuel pump. The fuel distribution line has a location element for each fuel injection valve, in which the inlet section of the fuel injection valve may be inserted, so that the location element surrounds the inlet section in the shape of a cup. In order to achieve the required sealing, the inlet section of each fuel injection valve has a sealing element in the form of an O-ring, which sealingly contacts the inner wall of the location element.

Due to the relatively high combustion pressure in each combustion chamber of the internal combustion engine, the hold-down device must exert a relatively high hold-down force in order to securely hold the fuel injection valves in their respective location holes on the cylinder head. However, the resulting rigid attachment of the fuel injection valves to the cylinder head makes the installation of the fuel distribution line difficult, since positional and angular deviations may occur between the inlet sections of the fuel injection valves and the location elements of the distribution line. Another contributing factor is that the fuel injection valves installed in the location holes of the cylinder head are not exposed to the hold-down force of the bracket in a uniform manner around their peripheries, but point-wise, which results in a slight tilt of the fuel injection valves in the location holes. The additional positional and angular deviations thus resulting at the inlet sections of the fuel injection valves make the assembly of the fuel distribution line even more difficult. The O-ring arranged between the inlet section of the fuel injection valve and the location element of the fuel distribution line compensates for the positional and angular deviations only to a very small, insufficient degree. In addition to the more difficult assembly, a fuel leakage danger at the seal that does not compensate for the positional and angular deviations also results in practice with Japanese Patent No. 08 312503.

German Patent No. 29 08 095 describes that a fuel injection valve not provided for direct injection of fuel may be fastened to a fuel distribution line using a holding clamp and the inlet section of the fuel injection valve may be inserted into the fuel distribution line via a plug nipple.

Compensation for the positional or angular deviations at the connection of the fuel injection valve with the fuel distribution line is not provided in this assembly arrangement.

SUMMARY OF THE INVENTION

The fuel injection system according to the present invention has an advantage over the conventional fuel injection systems in that positional and angular deviations resulting from manufacturing tolerances and assembly tolerances are reliably compensated. Thus, the assembly of the fuel injection system, in particular of the fuel distribution line, is considerably facilitated. Stressing of the fuel injection valves or the fuel distribution line, as may occur in the event of a connection that does not compensate for positional and angular deriations is avoided. Furthermore, no sealing problems occur between the fuel distribution line and the inlet sections of the fuel injection valves, since the sealing elements are not deformed on one side due to uncompensated for positional and angular deviations. Conversely, the fuel injection system improved on according to the present invention allows greater tolerances in the manufacturing of the cylinder head and the fuel distribution line, so that the manufacturing complexity, and thus the manufacturing cost, of these parts is reduced. The fuel distribution line may be installed relatively close to the cylinder head, so that little space is required.

The connection area between the fuel distribution line and the inlet section of the fuel injection valves may be relatively short and have a relatively wide cross-section, so that no pressure drop occurs when the fuel injection valves open.

It is particularly advantageous if two annular grooves are formed on the seal support to guide a first sealing element providing a radial seal and a second sealing element providing an axial seal. The radial seal seals against an end face of the inlet section of the fuel injection valve, while the axial seal seals against the connection fittings of the fuel distribution line.

It is particularly advantageous if the outer diameter of the seal support of the second, axial, upstream sealing element is larger than the outer diameter of the second annular groove associated with the radial sealing element. When the connection arrangement is exposed to the fuel pressure, a force component directed in the direction of the inlet section of the respective fuel injection valve is produced, which presses the first, radial sealing element onto the end face of the fuel injection valve inlet section. Thus a particularly effective seal is achieved and, at the same time, it is ensured that the seal support can be radially moved when there is no pressure during assembly. The radial mobility of the seal support can be further improved by an axial play, preferably provided, between the upstream collar of the sleeve and the inlet section of the fuel injection valve.

DETAILED DESCRIPTION.

Figure 1:
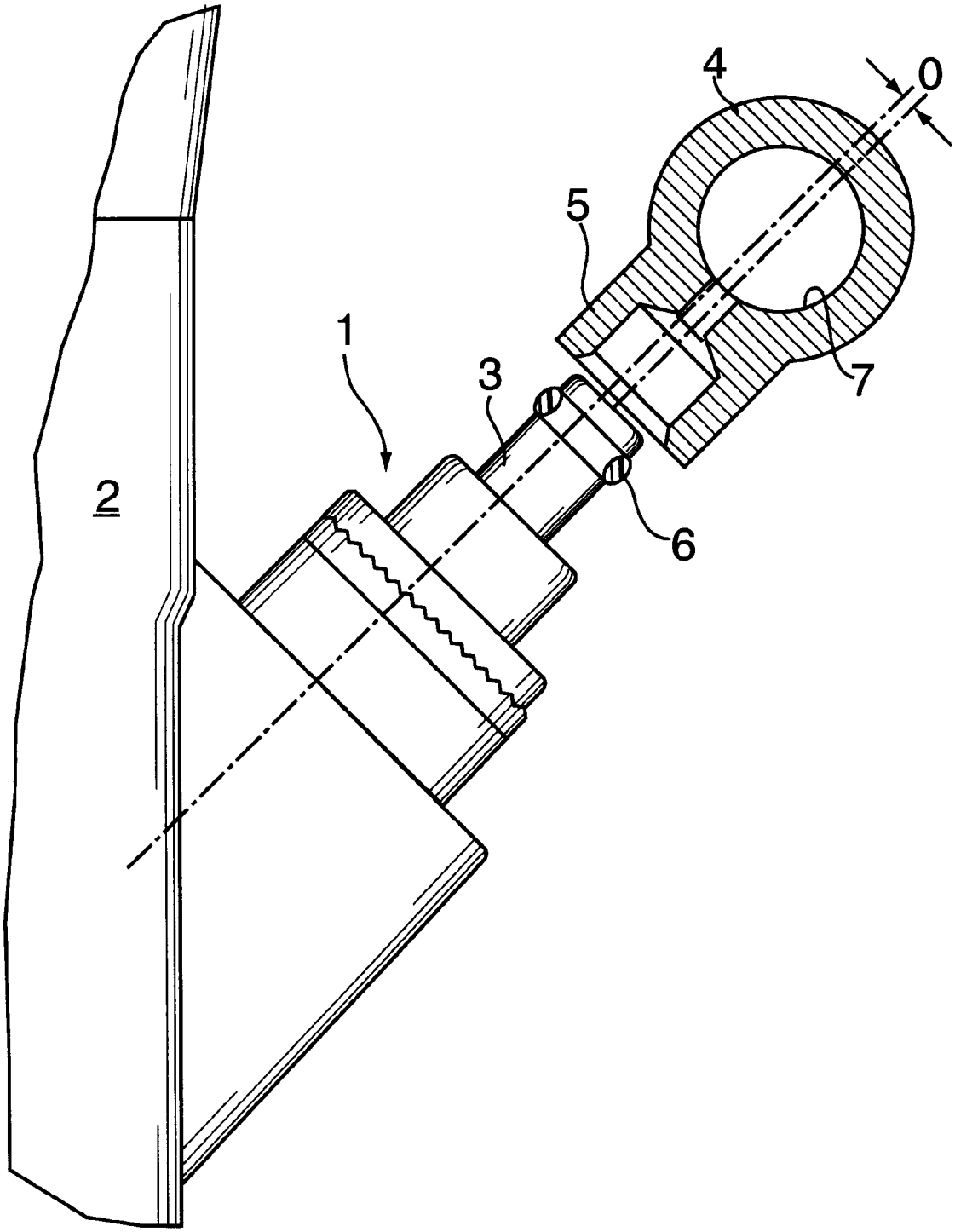
FIG. 1 PRIOR ART
FIG. 1 illustrates an assembly of a fuel injection valve and its connection with a sectionally shown fuel distribution line according to conventional fuel injection systems.
Figure 2:
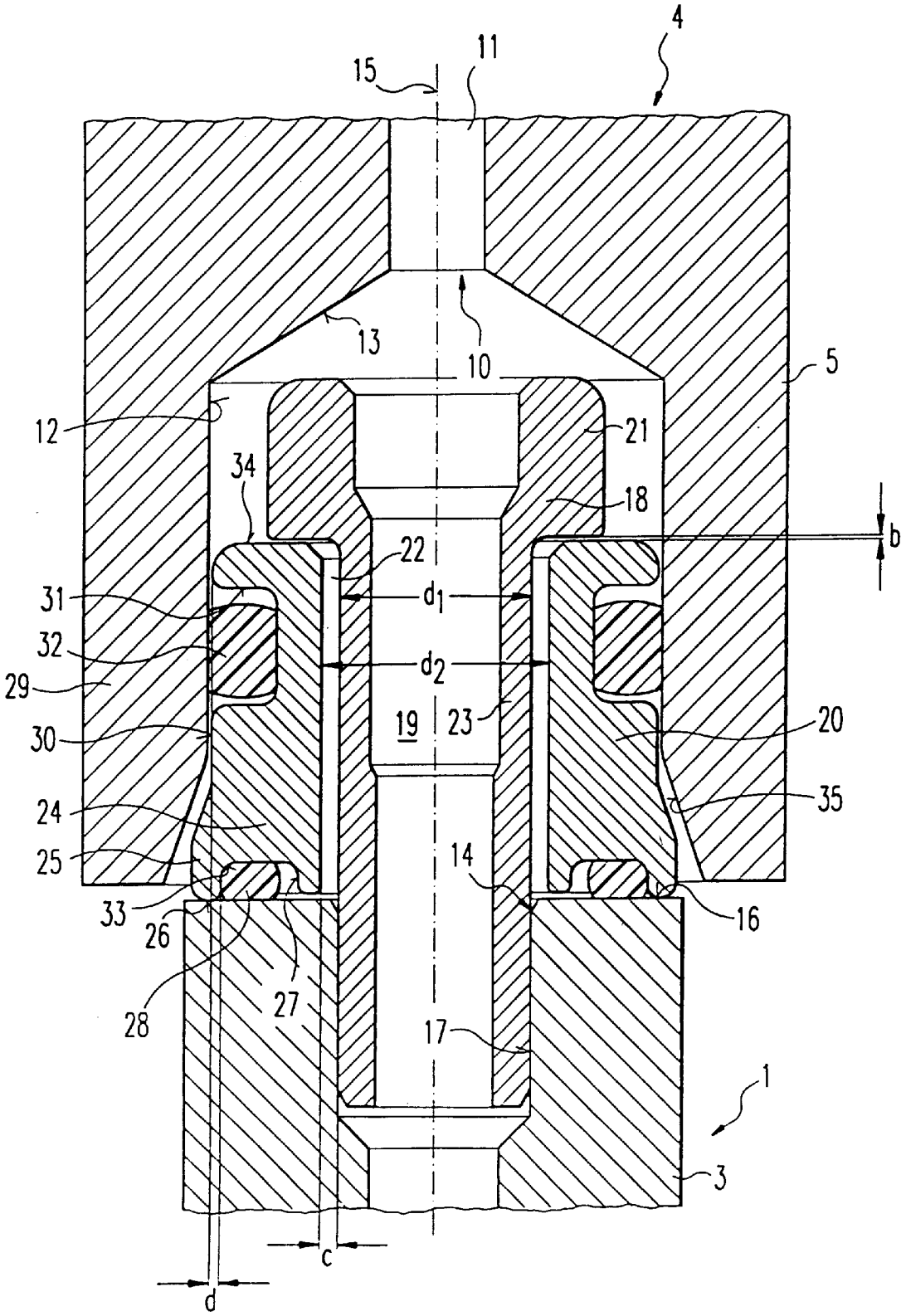
FIG. 2 illustrates a section through a portion of the connection between the fuel injection valve and the fuel distribution line of an embodiment according to the present invention.

Prior to describing in detail the embodiment of the present invention illustrated in FIG. 2, we shall briefly describe, with reference to FIG. 1, the conventional assembly of fuel injection valve 1 on cylinder head 2 of the internal combustion engine (not illustrated in detail) and the connection of inlet section 3 of fuel injection valve 1 with the fuel distribution line 4 illustrated as a section in FIG. 1.

Fuel injection valve 1 is installed in a relatively rigid manner on cylinder head 2 by inserting it in a cylinder head hole not illustrated in FIG. 1. Usually one fuel injection valve 1 is provided for each combustion chamber of the internal combustion engine. After inserting fuel injection valve 1 into the respective cylinder hole in cylinder head 2, fuel distribution line 4 is installed for supplying fuel from a fuel pump (not illustrated) to the individual fuel injection valve 1. Inlet section 3 of each fuel injection valve 1 is inserted in a respective fitting 5 of fuel distribution line 4 and sealed via a seal ring 6 provided on inlet section 3.

Due to the manufacturing and assembly tolerances, however, positional and angular deviations occur between the positions of inlet sections 3 of fuel injection valve 1 and the respective connecting fittings 5 of fuel distribution line 4. These positional and angular deviations are caused by the manufacturing tolerances in positioning the cylinder head holes for receiving fuel injection valve 1 and in positioning fittings 5 on fuel distribution line 4. Also, in mounting fuel injection valve 1 on cylinder head 2, a slight angular tilting may occur, resulting in an additional positional and angular deviation of inlet sections 3 from their desired position. The positional and angular deviations are compensated for by seal ring 6 only under certain conditions and unreliably, so that the assembly of fuel distribution line 4 is made considerably more difficult. In addition, for a greater positional deviation, which is indicated in FIG. 1 with a, fuel leakage at seal ring 6, which no longer seals reliably, may not be ruled out. The small allowable tolerances require high manufacturing accuracy and may be implemented without the connecting device according to the present invention only if the cylinder head holes and the recesses in fuel distribution line 4 are manufactured at the same time.

FIG. 2 shows a portion of one embodiment of the present invention as a section. Only the connection area between fuel injection valve 1 and fuel distribution line 4 is shown.

Fuel distribution line 4 has a fuel outlet orifice 10, which is connected to main channel 7, shown in FIG. 1, via a connecting hole 11. Connecting hole 11 opens into a location hole 12 of fitting 5. Location hole 12 narrows into a cone shaped section 13 in the direction of fuel outlet orifice 10.

Inlet section 3 of fuel injection valve 1 has a fuel inlet orifice 14, which is surrounded by an end face 16, extending perpendicularly to longitudinal axis 15 of fuel injection valve 1, i.e., radially. A stepped fuel inlet orifice 17 follows fuel inlet orifice 14 of fuel injection valve 1. A sleeve 18 may be inserted in fuel inlet orifice 14. In the embodiment shown, sleeve 18 may be fittingly pressed into fuel inlet orifice 17 and is stopped by friction. Alternatively, however, sleeve 18 may also be provided, on its downstream end, with an external thread and screwed into an internal thread of fuel inlet orifice 17.

In the embodiment shown in FIG. 2, sleeve 18 has a longitudinal bore 19, which has a stepped design in this embodiment and extends along longitudinal axis 15; its upstream end is connected to fuel outlet orifice 10 of fuel distribution line 4 via conical section 13 of location hole 12, and its downstream end is connected to fuel inlet orifice 17. Longitudinal bore 19 guides the fuel from this point on.

Sleeve 18, jointly with a seal support 20, forms a connection arrangement 18, 20 according to the present invention, which allows position compensation, within a given range of variation, between the position of inlet section 3 of fuel injection valve 1 and the position of fitting 5 of fuel distribution line 4.

Seal support 20 is secured between the inlet-side end face 16 of inlet section 3 and a collar 21, arranged at the inlet-side end of sleeve 18, projecting radially outside. Sleeve 18 is preferably pressed into inlet orifice 17 of fuel injection valve 1 only to a point where seal support 20 can be slightly moved axially within an axial tolerance range b shown in FIG. 2. Seal support 20 is therefore not rigidly pressed between collar 21 of sleeve 18 and inlet section 3 of fuel injection valve 1, but can move radially within a displacement range c also shown in FIG. 2. Only as an example and for elucidating the orders of magnitude, we shall mention that radial displacement range c may have an order of magnitude of approximately 0.6 mm, while axial tolerance range b of seal support 20 may be between 0.05 mm and 0.1 mm. Radial displacement range c is defined by the difference between the inner diameter $d_2$ of a passage bore 22 of annular seal support 20 and outer diameter $d_1$ of a penetration section 23 of sleeve 18. Penetration section 23 penetrates seal support 20 in the area of its passage bore 22.

Seal support 20 has, at its downstream end 24, a widening 25, directed radially outward. On one downstream radial end face 26 opposite end face 16 of inlet section 3 of fuel injection valve 1, a first peripheral annular groove 27, serving to accommodate and guide a first sealing element 28 in the form of a seal ring designed as an O-ring or a quad ring, is formed on seal support 20. First sealing element 28 is used as the radial seal and seals seal support 20 against inlet section 3 of fuel injection valve 1. The first sealing element 28 is slidingly movable on end face 16 of inlet section 3 of fuel injection valve 1.

Furthermore, seal support 20 has, on lateral surface 30 opposite one of walls 29 of fitting 5, a second annular groove 31. The second annular groove 31 is used to accommodate and guide a second sealing element 32 in the form of a seal ring designed as an O-ring or a quad ring. Second sealing element 32 seals seal support 20 axially against fittings 5. Second sealing element 32 may be slidingly moved in location hole 12 of fitting 5.

According to an exemplary embodiment of the present invention, outer edge 33 of annular groove 27 serving to accommodate first sealing element 28 is radially offset inward in relation to the outer diameter of seal support 20 in the area of second sealing element 32 by the amount d shown in FIG. 2. When seal support 20 is exposed to fuel during operation, the entire upstream end face 34 of seal support 20 up to its outer diameter is available as the surface of exposure to the fuel pressure. On the other hand, seal support 20 is exposed to fuel pressure on its downstream end at the most up to outer edge 33 of first annular groove 27, since the area that lies radially further outward is sealed. Seal support 20 is therefore exposed to an effective axial force component by the fuel pressure, which presses seal support 20 in the direction of fuel injection valve 1. First sealing element 28 is therefore pressed onto end face 16 of inlet section 3 of fuel injection valve 1, so that a good seal effect is obtained.

The connection arrangement 18, 20 according to the present invention may be fully inserted into location hole 12 of fitting 5 in its area that projects beyond inlet section 3 of fuel injection valve 1. The special advantage is achieved by the fact that annular seal support 20 allows both radial compensation and axial compensation between the position of inlet section 3 of fuel injection valve 1 and the position of location hole 12 of fitting 5 associated with fuel injection valve 1. While the first seal element 28 may be radially displaced on end face 16 of inlet section 3 for radial compensation, second seal element 32 may be axially displaced in location hole 12 of fitting 5 for axial compensation. To facilitate insertion of the connection arrangement 18, 20 according to the present invention, location hole 12 may have a conical section 35 in the area of its opening.

The assembly of fuel distribution line 4 on fuel injection valve 1 is considerably facilitated by the fuel injection system designed according to the present invention. In addition, pressure drops are largely avoided due to the short and wide fuel lines and the small distance between fuel distribution line 4 and fuel inlet orifices 14 of fuel injection valve 1. In sum, an extremely compact and flexible design results.

What is claimed is:

1. A fuel injection system for injecting fuel into an internal combustion engine, comprising:

a fuel injection valve having a fuel inlet orifice on an inlet section;

a fuel distribution line having a fuel outlet orifice, the fuel outlet orifice being connectable to the fuel inlet orifice of the fuel injection valve;

a connection fitting coupled to the fuel distribution line downstream from the fuel outlet orifice of the fuel distribution line; and a connection arrangement sealingly coupling the fuel inlet orifice of the fuel injection valve to the fuel outlet orifice of the fuel distribution line, the connection arrangement including an annular support, a first sealing element sealing the seal support against the inlet section of the fuel injection valve, a second sealing element sealing the seal support against the connection fitting, and a sleeve for inserting in the fuel inlet orifice, the sleeve traversing the seal support so that the seal support is radially movably secured between an upstream collar of the sleeve and the inlet section of the fuel injection valve.

2. The fuel injection system according to claim 1, wherein the seal support has a first annular groove, the first sealing element being guided in the first annular groove and is slidingly movable radially on one end face of the inlet section of the fuel injection valve.

3. The fuel injection system according to claim 2, wherein the first annular groove is formed on a downstream end face of the seal support and extends radially, opposite the end face of the inlet section.

4. The fuel injection system according to claim 2, wherein an outer diameter of the seal support upstream from the second sealing element is larger than an outer diameter of the first annular groove.

5. The fuel injection system according to claim 1, wherein the seal support has a second annular groove, the second sealing element being guided in the second annular groove and is slidingly movable axially on a wall of the connection fitting.

6. The fuel injection system according to claim 5, wherein the second annular groove is formed on an axial lateral surface of the seal support opposite the wall of the connection fitting.

7. The fuel injection system according to claim 1, wherein the sleeve has a longitudinal bore for conducting fuel.

8. The fuel injection system according to claim 1, wherein the seal support has a passage bore , the passage bore being traversed by a penetrating section of the sleeve, an inner diameter of the passage bore of the seal support being greater than an outer diameter of the penetrating section of the sleeve.

9. The fuel injection system according to claim 1, wherein the sleeve is inserted in the fuel inlet orifice of the fuel injection valve so that the seal support is axially movable between the upstream collar of the sleeve and the inlet section of the fuel injection valve within a preselected tolerance range.

10. The fuel injection system according to claim 1, wherein the connection arranged is inserted in the connection fitting.

11. The fuel injection system according to claim 1, wherein the first sealing element and the second sealing element include a peripheral annular seal.

12. The fuel injection system according to claim 1, wherein the sleeve is fitted into the fuel inlet orifice of the fuel injection valve.

* * * * *

UNITED STATES PATENT AND TRADEMARK OFFICE

CERTIFICATE OF CORRECTION

PATENT NO. : 6,102,007
DATED : August 15, 2000
INVENTOR(S) : Thomas Furst

It is certified that error appears in the above-identified patent and that said Letters Patent is hereby corrected as shown below:

Abstract,
Line 8, after "arrangement" insert -- , connecting the fuel inlet orifice of each fuel --.

Column 2,
Line 16, change "... deriations ..." -- deviations, --.
Line 64, change "DESCRIPTION." to -- DESCRIPTION --.

Column 3,
Line 32, change "... with a ..." to -- with a --.

Column 4,
Line 61, delete "effect ...".

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*